US010858845B1

(12) United States Patent
Majewski

(10) Patent No.: US 10,858,845 B1
(45) Date of Patent: Dec. 8, 2020

(54) TACTILE SOUND FLOORING SYSTEM

(71) Applicant: Jari Majewski, Golden, CO (US)

(72) Inventor: Jari Majewski, Golden, CO (US)

( * ) Notice: Subject to any disclaimer, the term of this patent is extended or adjusted under 35 U.S.C. 154(b) by 0 days.

(21) Appl. No.: 16/683,804

(22) Filed: Nov. 14, 2019

(51) Int. Cl.
*E04F 15/02* (2006.01)
*E04F 15/024* (2006.01)
*H04R 1/02* (2006.01)

(52) U.S. Cl.
CPC .... *E04F 15/0247* (2013.01); *E04F 15/02417* (2013.01); *H04R 1/025* (2013.01); *H04R 1/028* (2013.01); *E04F 2290/00* (2013.01); *H04R 2400/11* (2013.01)

(58) Field of Classification Search
CPC ..... E04F 15/0247; E04F 15/02417; E04F 2290/00; E04F 15/02411; E04F 15/02462; E04F 15/02464; H04R 1/025; H04R 1/028; H04R 2400/11
See application file for complete search history.

(56) References Cited

U.S. PATENT DOCUMENTS 5,097,821 A * 3/1992 Eakin ..... A61H 23/0236 601/47
7,081,083 B2 * 7/2006 Ardizzone ..... A61H 23/02 600/9
7,418,108 B2 * 8/2008 Oser ..... H04R 9/06 381/401
7,490,439 B2 * 2/2009 Teramura ..... E04F 15/02411 52/126.6
8,761,417 B2 6/2014 Oser et al.
9,483,922 B2 11/2016 Kawamoto
2005/0120650 A1 * 6/2005 Teramura ..... E04F 15/02452 52/263
2006/0248814 A1 * 11/2006 Chen ..... E04F 15/02476 52/126.6
2009/0010468 A1 1/2009 Oser et al.
2017/0150264 A1 * 5/2017 Nelson ..... A47C 7/72
2018/0313558 A1 * 11/2018 Byers ..... E04B 9/04
2019/0251949 A1 * 8/2019 Ekuni ..... H04R 1/403

* cited by examiner

*Primary Examiner* — Patrick J Maestri
(74) *Attorney, Agent, or Firm* — Snell & Wilmer L.L.P.; Russell T. Manning

(57) ABSTRACT

Presented herein, is a modular tactile flooring system. The tactile flooring system is made form individual modules that each support a tactile transducer. The individual modules may be assembled to form a tactile dance floor. More specifically, the modules may interlock to form a single dance floor surface. Further, the modules may be individually leveled to provide a level surface even when an underlying support surface is uneven. that facilitates assembly of a tactile sound floor and readily permits the tactile sound floor to be assembled in a desired location.

17 Claims, 7 Drawing Sheets

TACTILE SOUND FLOORING SYSTEM

FIELD

The present disclosure is directed to a tactile sound flooring system where sound is felt through touch and heard via bone conduction.

BACKGROUND

Most individuals with normal hearing perceive sounds through both their eardrums (air-conducted or air-transmitted) and their bones (bone-conducted or bone-transmitted). For these individuals, sounds are primarily perceived by their eardrums. That is, the eardrum converts the sound waves to vibrations and transmits them to the cochlea (or inner ear). In addition, sound is also perceived via vibrations conducted to the inner ear through the bones of the skull. That is, bone conduction transmission occurs as sound waves vibrate bones of the skull. For these individuals, sounds are a combination of air-conducted and bone-conducted vibrations.

Many hearing-impaired individuals are unable able to perceive sound through their ear canal (i.e., air-conducted vibrations) but can perceive sound via bone conduction. Along these lines, various bone conduction hearing aids have been developed. Such devices are typically placed near the ear to provide vibrations directly to the skull thereby allowing a wearer to perceive or hear sounds. Further, tactile sound systems have been designed that allow individuals to perceive sound through touch when touching a surface associated with the tactile sound system.

Tactile sound systems utilize a tactile transducer that, typically, generates frequencies can be felt as well as heard. More specifically, the transducer or 'shaker' transmits vibrations into various surfaces so that they can be felt by people touching the surface. This is called tactile sound. The vibrations felt by a person induce bone conduction for both hearing and hearing-impaired individuals. That is, such individuals are able to hear the output of the tactile transduce via such bone conduction. In various applications, such systems allow hearing impaired individuals to both feel and hear music.

In an application, multiple tactile transducers may be integrated into a dance floor to create a tactile sound floor, which allows hearing impaired individuals the opportunity to dance while hearing music via tactile sound.

SUMMARY

Aspects of the present disclosure are based on the realization that, while tactile transducers may be incorporated into a dance floor allowing hearing impaired individuals to experience music while they dance, tactile sound floors are difficult to construct and require individuals to travel to locations where such a specialized flooring system is assembled. Presented herein, is a modular flooring system that facilitates assembly of a tactile sound floor and readily permits the tactile sound floor to be assembled in a desired location. In the latter regard, such a tactile sound floor may be portable allowing hearing-impaired outreach programs to bring such a tactile sound floor to different communities.

The modular tactile sound floor is formed of individual modules that may be connected together to produce a contiguous dance floor. Each module may include a plate having an upper surface and an lower surface. In an arrangement, the plates are rectangular (e.g., square). A frame is attached to the bottom surface of the plate generally about the periphery of the plate. A tactile transducer is attached to the bottom surface of the plate within an open interior of the frame. Support feet may be attached to the frame (e.g., near some or all of the corners of the frame) to support the frame and supported plate above a support surface. The bottom edge of one or more sides of the frame may include frame supports that extend outward form the frame. This allows these one or more sides of the frame of a first module to support the bottom edge of a frame of one or more adjacent modules. In an arrangement, the frame supports include an angle bracket having an upward portion that extends on an inside surface of the adjacent frame. This allows interlocking the modules together when assembled. In an arrangement, the support feet are adjustable to permit leveling the module. In a specific arrangement, the support feet include a threaded shaft that may be adjusted through an aperture in the overlying plate. Such an arrangement permits leveling an individual module after it is connected to one or more adjacent modules.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Presented herein is a tactile sound floor system that allows users to both feel and hear music when in contact with the tactile floor system. One primary use of the tactile floor system is for hearing-impaired individuals. That is, the tactile floor system allows hearing impaired individuals to both feel music as well as hear the music via bone conduction. Further, the tactile floor system is modular. This facilitates assembly of the tactile flooring system as well as making the tactile flooring system portable. In the latter regard, individual modules of the tactile flooring system are adjustable in height such that, when multiple modules are assembled, the resulting tactile surface may be leveled even if assembled on an uneven surface.

Figure 1:
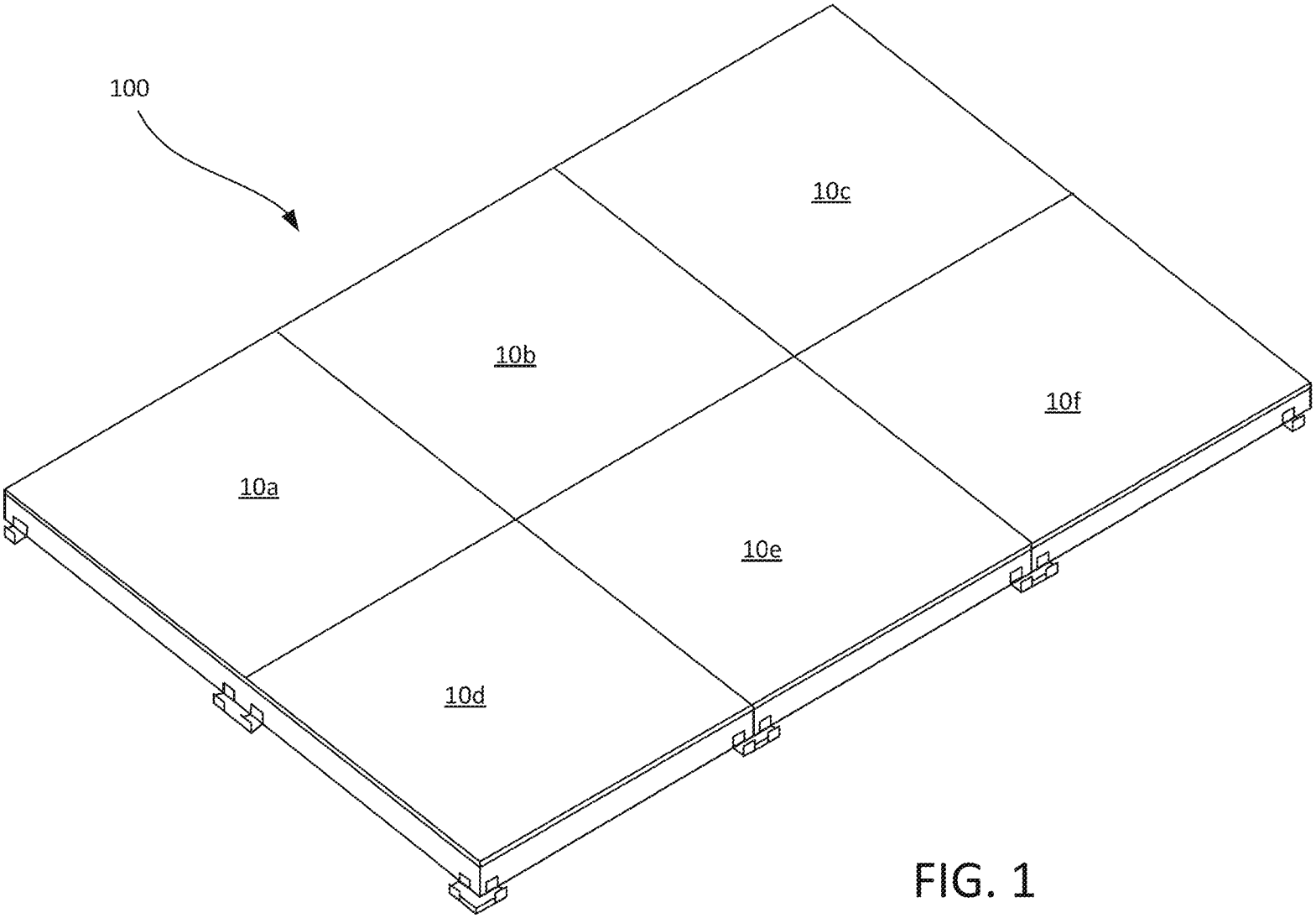
FIG. 1 illustrates a perspective view of a tactile flooring system formed of interconnected tactile floor modules.

FIG. 1 illustrates one embodiment of an assembled tactile flooring system 100 in accordance with the present disclosure. As shown, the tactile flooring system 100 is formed from interconnected floor modules 10*a*-10*f* (hereafter '10' unless specifically referenced. In the illustrated embodiment, the tactile flooring system 100 includes six interconnected modules. However, it will be appreciated that additional modules may be added and the depiction of six modules is presented for purposes of illustration only. As further discussed herein, each module 10 includes a tactile transducer or shaker (not shown) attached below an upper surface of the module. The tactile transducer is connectable to an audio signal (e.g., from an amplifier). In operation, the tactile transducers applies vibrations to the upper surface of the module in response to the audio signal. When individuals stand or dance on the upper surface of the flooring system 100, vibrations applied to the upper surfaces of the modules 10 are transmitted to the individuals inducing bone conduction hearing. This allows the individuals to both feel and hear the music or other sounds applied to the modules via their individual tactile transducers.

Figure 2A:
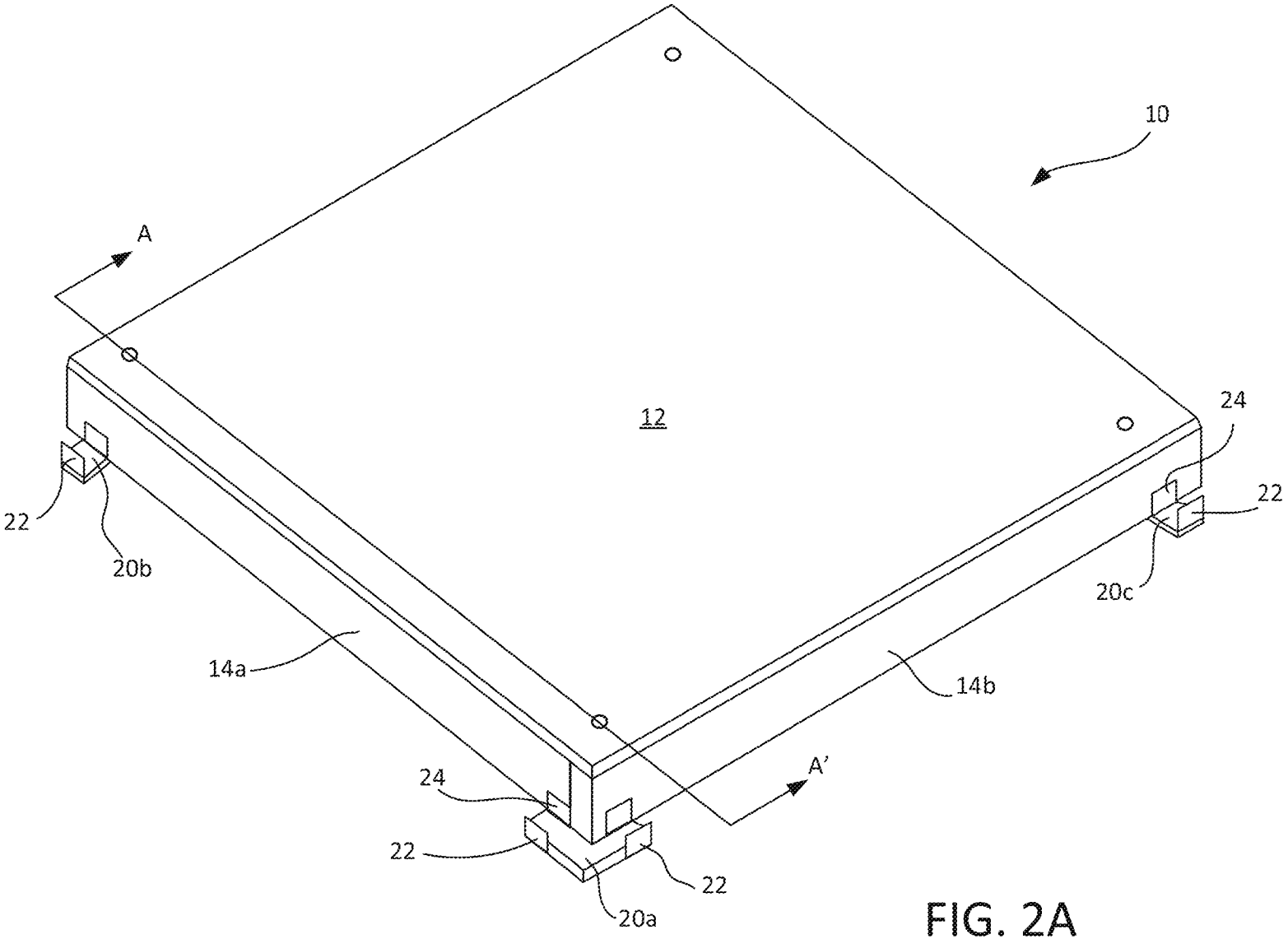
FIGS. 2A and 2B illustrate top and bottom perspective views of a tactile floor module, respectively.
Figure 2B:
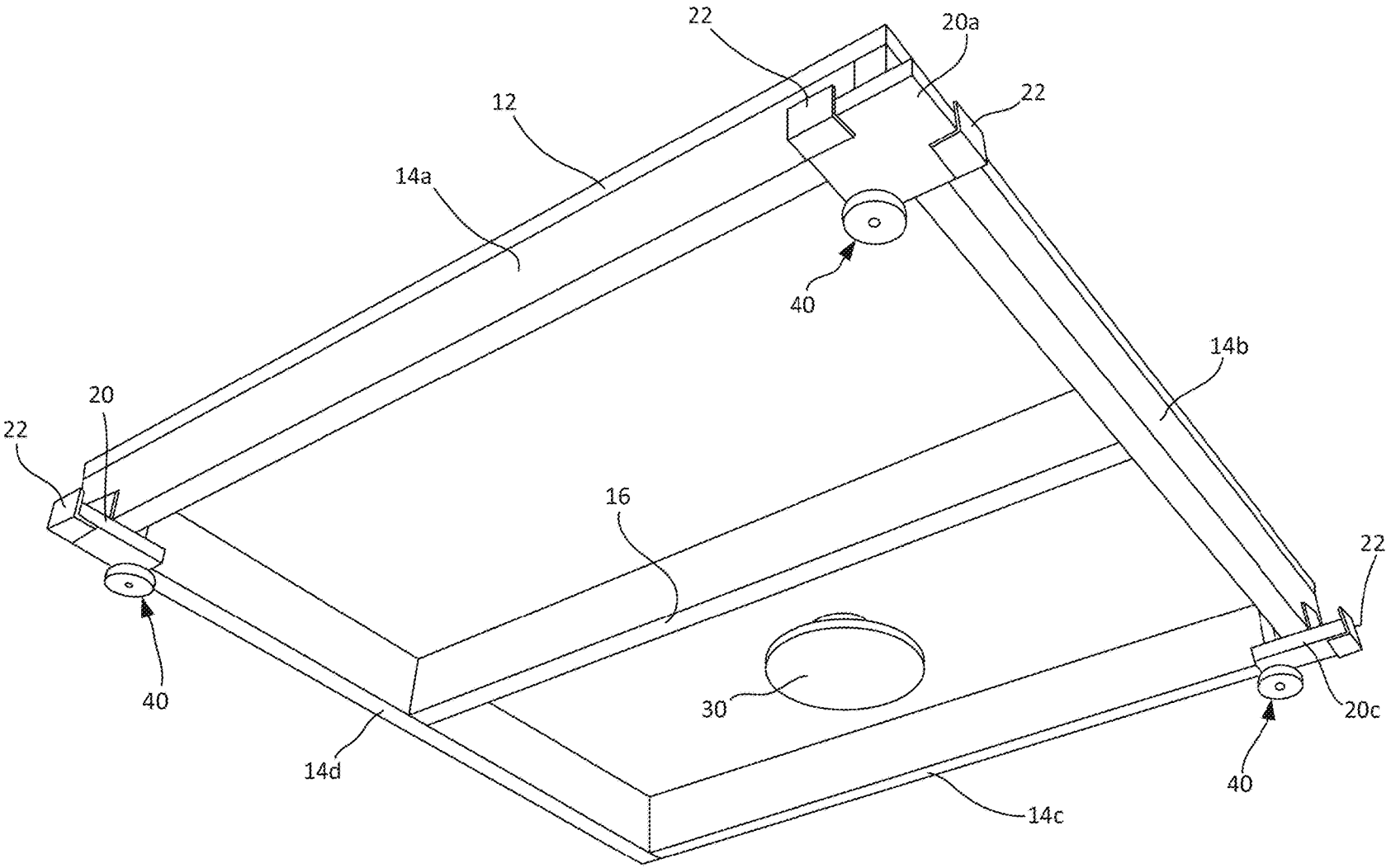

FIGS. 2A and 2B illustrate top and bottom perspective views, respectively, of a tactile floor module 10. As shown, the floor module 10 includes a substantially rigid top surface or plate 12. An upper surface of the plate 12 is a substantially plate is substantially planar. In an embodiment, the plate 12 is made from ¾ inch plywood. However, it will be appreciated that various other materials may be utilized. In the illustrated embodiment, the plate 12 is a square member though other shapes are possible. An upper surface of the plate 12 forms the top surface of the module 10. Affixed to the bottom surface of each peripheral edge of the plate 12 is a frame, which in the illustrated embodiment is formed of four vertical risers 14*a-d* (hereafter 14 unless specifically referenced). As shown, the upper edge of the frame (e.g., risers 14) is attached to the bottom surface of the plate 12. In an embodiment, the vertical risers 14 are formed from 2×4 wood studs. Other materials are possible. When the plate and risers are formed from wood, the plate 12 may be affixed to the risers 14 utilizing, for example, wood screws and/or adhesives. Further the individual risers 14 may be connected (e.g., screwed together) at the corners where the risers meet. In the illustrated embodiment the risers 14 collectively form a four-sided frame having a generally hollow or open interior. As best shown in FIG. 2B, the plate 12 extends over the open interior of the frame and is supported about its periphery by the upper edges of the risers 14. One or more cross-braces 16 may extend between opposing risers. However, this is not a requirement. When utilized, the cross-brace(s) 16 may increase the rigidity of the upper surface of the plate 12. Such a cross-brace 16 may be affixed on each end to opposing riser 16. Further, the plate 12 may be attached (e.g., screwed) to the cross-brace 16 along its length.

Figure 4A:
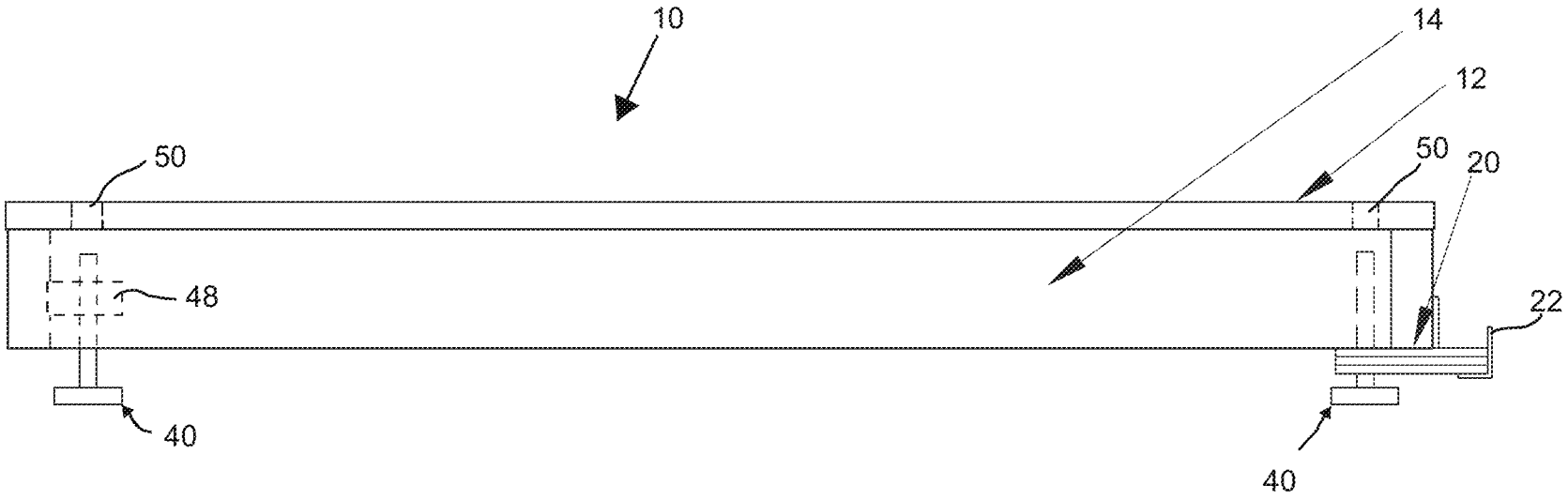
FIGS. 4A and 4B illustrate a side view and a cross-sectional side view of a tactile floor module.
Figure 4B:
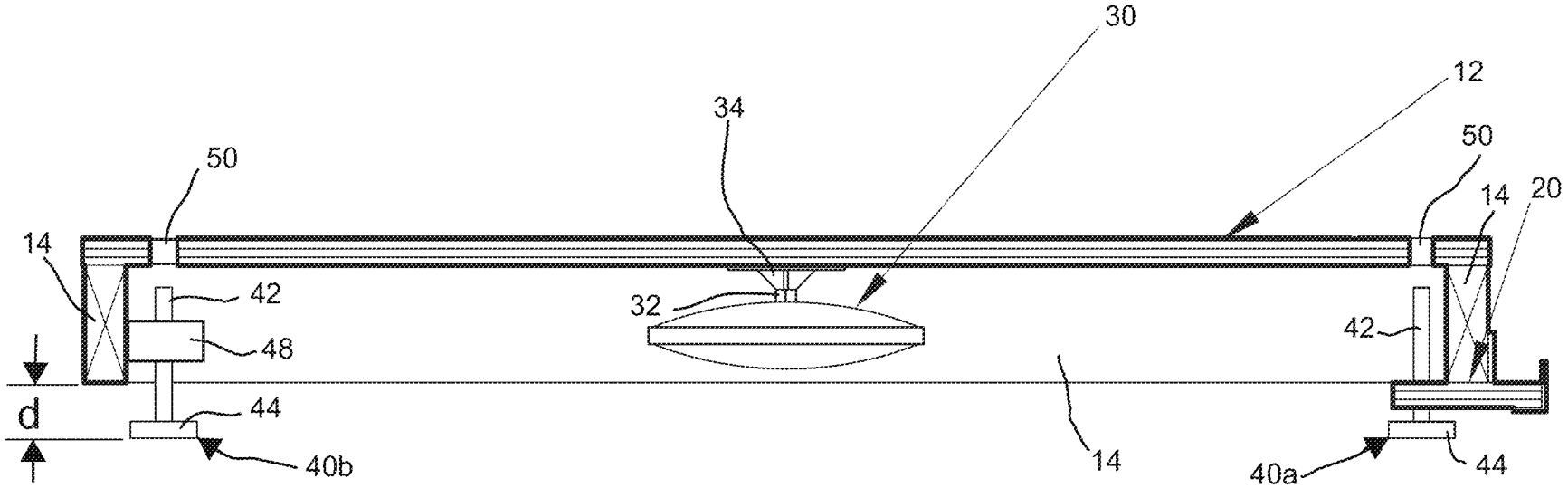

As illustrated in FIG. 2B, a tactile transducer 30 is fixedly attached to the bottom side of the plate 12 within the open interior of the frame defined by the risers 14. Typically, the tactile transducer houses a small weight that is driven by a coil, which is driven by an audio signal from an amplifier (not shown). When multiple modules are connected, each tactile transducer of each module may be attached to such an audio signal. The coil exerts force on both the weight and the body of the transducer, with the latter forces being transmitted into the plate 12. One exemplary embodiment of a tactile transducer is the TST429 Platinum Professional Transducer produced by Clarksynthesis of Littleton, Colo. As best shown in FIG. 4B, the transducer 30 is mounted to the bottom side of the plate via a mounting stud 32 and bracket 34. As shown, the transducer is suspended above a bottom edge of the risers such that movement/vibration of the transducer 30 is applied to the plate 12.

As best shown in FIGS. 2A and 2B, the bottom edge of the frame further includes supports that are configured to support the bottom edge of a frame of an adjacent module. More specifically, at least two of the risers (e.g., 14*a*, 14*b*) of the module 10 further include frame or riser supports 20*a*, 20*b* and 20*c* (hereafter 20 unless specifically referenced) that are configured to support the bottom edge of a frame or riser of an adjacent module. The riser supports 20 are fixedly attached to the bottom edge of the risers 14 and extend generally perpendicular to their riser. In an embodiment, the riser supports 20 extend laterally inward (e.g., toward the area enclosed by the frame) beyond an inside edge of the riser to which the support is attached. In such an embodiment, the portion of the riser support that extends inward may provide a mount for a foot that supports the module. In any embodiment, a portion of the riser support 20 extends outward beyond an outside edge of the riser to which the riser is attached. This outward portion supports a riser/frame of an adjacent module when the flooring system is assembled as further discussed below. In an embodiment, the riser supports 20 are wood or metal blocks that are mechanically affixed to the bottom edges of the risers 14. As shown, one of the riser supports 20*a* is a corner support configured to extend outward from two of the risers 14*a*, 14*b* such that it may support risers of two adjacent floor modules.

Figure 3A:
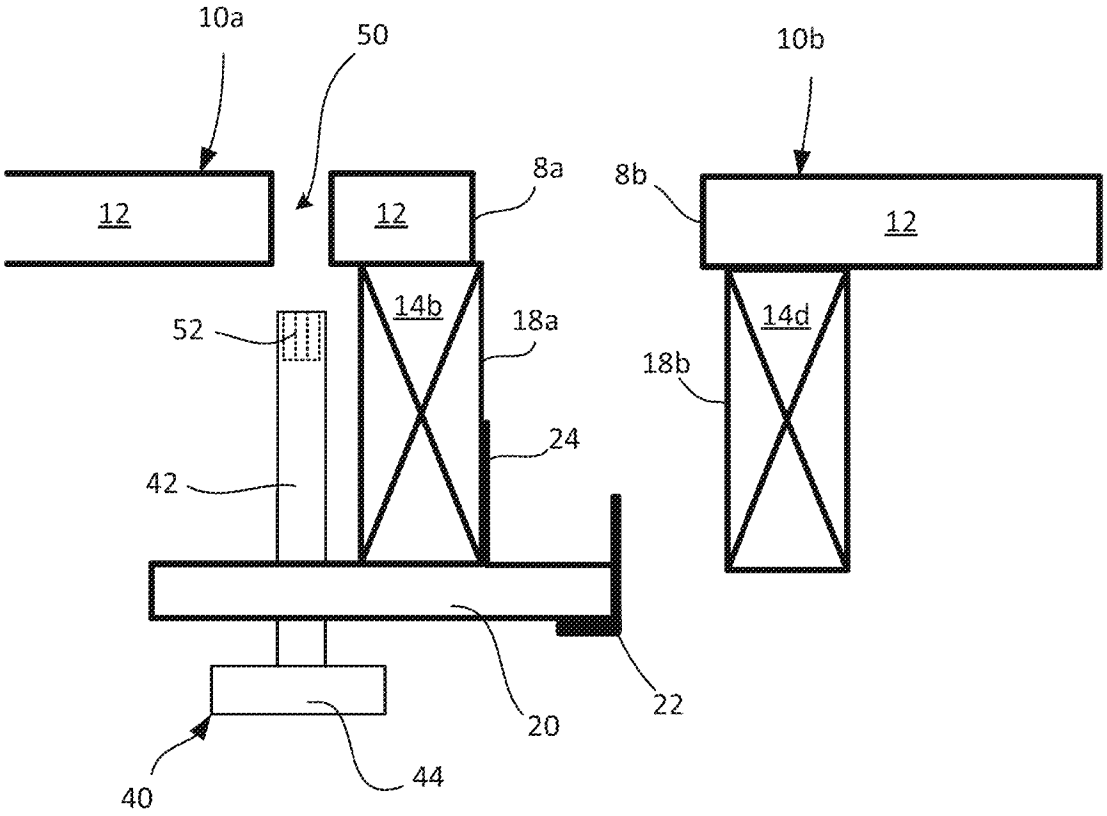
FIGS. 3A and 3B illustrate adjacent floor modules prior to connection and after connection, respectively.
Figure 3B:
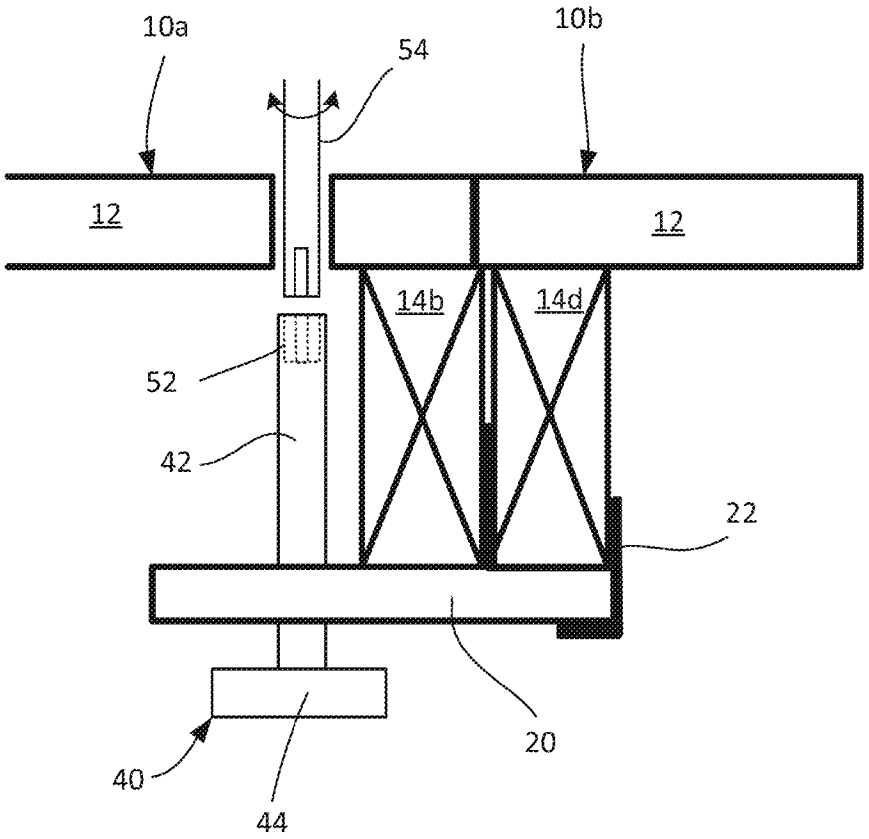

The outward edge of each of the riser supports 20 may further include one or two angle brackets 22 attached to the bottom edge of the riser support 20 and extending upward over the outer edge of the riser support 20. As shown in FIGS. 3A and 3B, the riser supports 20 and angle brackets 22 of a first module 10*a* allow for attaching an unsupported riser of an adjacent floor module (e.g., second floor module 10*b*). As shown, the riser support 20 extends outwardly from the outer edge of the supported riser 14*b* a distance that is approximately equal to the width of the unsupported riser 14*d* (i.e., of the adjacent module 10*b*). As shown in FIG. 3B, when assembled, the bottom edge of the unsupported riser 14*d* is supported on the upper surface of the riser support 20 while an upper extension of the angle bracket 22 is disposed on an inside surface of the unsupported riser 14*b*. Stated otherwise, the riser support and angle bracket engage an unsupported riser of an adjacent module to lock two modules together. Along these lines, each edge of a module that supports and adjacent module will typically have at least two spaced riser supports/brackets to engage an adjacent module. In an embodiment, a resilient spacer 24 may be disposed on an outward edge of the supporting riser 14*b*. When utilized, the resilient spacer compresses between the risers when the floor modules are assembled minimizing movement between the floor modules.

In the illustrated embodiment, the floor module 10 further include support feet 40 on two, three or four corners. The support feet 40 suspend the modules above a supporting surface (e.g., floor). Further, the support feet 40 are adjustable such that the upper surface of the plate may be leveled and/or to permit adjacent modules to have an equal height even if they are assembled on an uneven surface. The support feet 40 are best illustrated in FIG. 2B and FIGS. 4A and 4B, which illustrate a side view of the floor module 10 and a cross-sectional side view of the floor module taken along section A-A' (see. FIG. 2A). In the illustrated embodiment, each support foot 40 includes a threaded shaft 42 and an isolation pad 44 attached to a lower end of the threaded shaft 42.

The threaded shaft 42 of a support foot 40 may pass through a portion of the riser support 20 that extends inwardly from the riser 14 to which the support foot 40 is attached. See right foot 40*a* of FIG. 4B. Alternatively, the threaded shaft may pass through a support block 48 attached to an inside surface of a riser. See left foot 40*b* of FIG. 4B. In either case, the riser support or support block may include a threaded aperture (not shown) through which the threaded shaft 42 passes. For instance, a threaded nut may be press fit and/or adhered within an aperture passing through the support. Accordingly, by rotating the threaded shaft 42, the distance 'd' between the bottom of the isolation pad 44 and the bottom edge of the riser 14 may be adjusted. See FIG. 4B. Stated otherwise, the height of a top surface of the plate 12 may be adjusted using by advancing or retracting the threaded shaft 42.

To facilitate adjustment of the individual floor modules after assembly, the plate 12 includes apertures 50 that are aligned with the upper end of the threaded shafts 42 of the support feet. These apertures 50 allow for engaging the upper end of the threaded shafts 42 after the modules 10 are assembled to adjust the height of the support feet. Along these lines the upper end of each threaded shaft 42 may include, for example, an external hex head or an internal hex or torx key 52 or similar mechanical engagement element. See FIGS. 3A and 3B. That is, the upper end of the threaded shaft includes a drive element configured for engagement with a rotary driver (e.g., socket, bit, etc.) This allows an assembler to dispose a corresponding socket or bit 54 through the aperture 50 to adjust the height of each corner of the module having a support foot 40.

To enhance the vibration applied to the upper plate 12 of the module, each support foot may include an isolator pad 44, which may be formed of a resilient material. Such materials include, without limitation, synthetic rubbers and natural rubbers to name a few. The isolators 44 minimize transmission of vibrations to a supporting surface. One exemplary isolator is the T1-100 isolation foot produced by Clarksynthesis of Littleton, Colo.

To enhance vibration transmission between adjacent modules, some embodiments of the modules utilize an offset plate 12. In such an embodiment, two adjacent edges of the plate extend slightly over their underlying risers while the two other adjacent edges of the plate do not extend to the outer edge of their underlying risers. This is best illustrated in FIGS. 3A and 3B. As shown in FIG. 3A, the outer edge 8*a* of one side of the plate 12 of one module 10*a* is set back slightly from the outer edge 18*a* of its riser 14*b* while outer edge 8*b* the plate 12 of the adjacent module 10*b* slightly overhangs the outer edge 18*b* of its riser 14*d*. When assembled, the overhanging portion of the plate of module 10*b* is supported on the upper surface of the riser 14*b* of the adjacent module 10*a*. See FIG. 3B. Accordingly, vibrations generated by each module are more effectively transferred to an adjacent module.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A tactile sound flooring module, comprising:

a plate having a planar upper surface;

a frame having an upper edge attached about a lower peripheral edge of a bottom surface of the plate and extending transversely away from the bottom surface of the plate to a lower edge;

a tactile transducer attached to the bottom surface of the plate, wherein the tactile transducer is disposed within an open interior of the frame;

at least first and second supports attached to the lower edge of the frame and having a portion extending transversely outward beyond an outer edge of the frame, wherein the first and second supports are configured to support a lower edge of a frame of an adjacent tactile sound floor module; and at least a first and second support foot disposed within the open interior of the frame, wherein each support foot is attached to the frame and has a lower end that is disposed below the lower edge of the frame.

2. The module of claim 1, wherein each support foot is adjustable.

3. The module of claim 2, wherein each support foot comprises: a threaded shaft extending through a threaded aperture supported by the frame, wherein advancing and retracting the threaded shaft relative to the threaded aperture adjusts the position of the lower end of the foot relative to the lower end of the frame.

4. The module of claim 3, wherein an upper end of the threaded shaft further comprises:

a drive element configured for engagement with a rotary driver.

5. The module of claim 4, wherein the plate further comprises:

an aperture disposed above each threaded shaft, wherein the aperture is sized to provide access to the upper end of the threaded shaft through the planar upper surface.

6. The module of claim 3, further comprising:

a resilient isolator attached to the lower end of the threaded shaft.

7. The module of claim 3, wherein the threaded aperture is supported by a portion of a support extending transversely beyond an inner edge of the frame.

8. The module of claim 1, wherein each support comprises:

an angle bracket.

9. The module of claim 8, wherein the angle bracket comprises an upward portion of the angle bracket extends beyond an upper surface of the support.

10. The module of claim 9, wherein a distance between an inside surface of the upward portion of the angle bracket and the outer edge of the frame is at least equal to a thickness of the frame between an inside edge of the frame and the outer edge.

11. The module of claim 1, wherein the plate is a rectangular plate.

12. The module of claim 11, wherein first and second adjacent edges of the rectangular plate extend over outside edges of the frame.

13. The module of claim 12, wherein third and fourth edges of the rectangular plate are set back from outside edges of the frame.

14. A tactile flooring system, comprising:

first and second tactile sound modules each having:

a plate disposed over a frame attached about a lower peripheral edge of a bottom surface of the plate and extending transversely away from the bottom surface of the plate to a lower edge;

support feet supporting a bottom edge of the frame above a support surface, wherein each support foot of each module comprises:

a threaded shaft extending through a threaded aperture supported by the frame, the threaded shaft having an upper end with a drive element configured for engagement with a rotary driver, wherein advancing and retracting the threaded shaft relative to the threaded aperture adjusts the position of the lower end of the support foot relative to the lower end of the frame; and a tactile transducer attached to the bottom surface of the plate; and wherein a bottom edge of one side of the frame of the second module is supported on an upper surface of frame support attached to the bottom edge of an adjacent side of the frame of the first module.

15. The tactile flooring system of claim 14, wherein the plate of each module further comprises:

an aperture disposed above each threaded shaft, wherein the aperture is sized to provide access to the upper end of the threaded shaft through an upper surface of the plate.

16. The tactile flooring system of claim 14, further comprising:

a resilient isolator attached to the lower end of the threaded shaft.

17. The tactile flooring system of claim 14, wherein an edge of the plate of the second module extends over an outside edge of the frame of the second module and is supported on an upper surface of the frame of the first module.

* * * * *